US008590458B2

(12) United States Patent
Wieser

(10) Patent No.: US 8,590,458 B2
(45) Date of Patent: Nov. 26, 2013

(54) CHAIR-LIFT

(75) Inventor: Hartmut Wieser, Racines (IT)

(73) Assignee: Rolic Invest S.AR.L., Luxembourg (LU)

( * ) Notice: Subject to any disclaimer, the term of this patent is extended or adjusted under 35 U.S.C. 154(b) by 932 days.

(21) Appl. No.: 12/596,626

(22) PCT Filed: Apr. 18, 2008

(86) PCT No.: PCT/EP2008/054771

§ 371 (c)(1),
(2), (4) Date: Jan. 20, 2010

(87) PCT Pub. No.: WO2008/129017

PCT Pub. Date: Oct. 30, 2008

(65) Prior Publication Data

US 2010/0154671 A1 Jun. 24, 2010

(30) Foreign Application Priority Data

Apr. 20, 2007 (IT) ..... MI07U0157

(51) Int. Cl.
*B61B 11/00* (2006.01)
*B61B 10/02* (2006.01)

(52) U.S. Cl.
USPC ..... 105/149.2

(58) Field of Classification Search
USPC ..... 105/149.1, 149.2; 297/423.1, 423.19, 297/423.25, 423.26; 472/124, 125
See application file for complete search history.

(56) References Cited

U.S. PATENT DOCUMENTS

| | | | |
|---|---|---|---|
| 472,211 | A | 4/1892 | Fralinger |
| 1,944,446 | A | 1/1934 | McGowen |
| 2,662,587 | A | 12/1953 | McIlvaine |
| 2,710,650 | A | 6/1955 | Sowder |
| 2,985,224 | A | 5/1961 | Sowder |
| 3,170,412 | A | 2/1965 | Sowder |
| 3,934,517 | A | 1/1976 | Hirsig |
| 4,185,562 | A | 1/1980 | Hatori et al. |
| 4,226,187 | A | 10/1980 | Paulsen et al. |
| 4,269,123 | A | 5/1981 | Segafredo |
| 4,280,411 | A | 7/1981 | Katayose et al. |
| 4,462,314 | A | 7/1984 | Kunczynski |
| 4,470,355 | A | 9/1984 | Kunczynski |
| 4,473,011 | A | 9/1984 | Wuschek |
| 4,640,197 | A | 2/1987 | Brian |

(Continued)

FOREIGN PATENT DOCUMENTS

| | | |
|---|---|---|
| AT | 315910 | 6/1974 |
| AT | 342655 | 4/1978 |

(Continued)

OTHER PUBLICATIONS

First Office Action for JP 2010-503528 and an English Summary of the Office Action.

*Primary Examiner* — Zachary Kuhfuss
(74) *Attorney, Agent, or Firm* — Neal, Gerber & Eisenberg LLP

(57) ABSTRACT

A chair-lift has a chair, in turn having a seat, a safety bar rotating about a first axis between an open position and a closed position, and at least one footrest bar supported by the safety bar and mounted to rotate about a second axis to move the footrest bar with respect to the seat, when the safety bar is in the closed position.

24 Claims, 3 Drawing Sheets

(56) References Cited

U.S. PATENT DOCUMENTS

| | | | | |
|---|---|---|---|---|
| 4,641,587 | A | 2/1987 | Dalliard | |
| 4,671,187 | A | 6/1987 | Kunczynski | |
| 4,833,997 | A | 5/1989 | Cathiard | |
| 4,844,547 | A * | 7/1989 | Adkins | 297/423.38 |
| 4,898,100 | A | 2/1990 | Brochand | |
| 5,107,771 | A | 4/1992 | Kainz | |
| 5,113,768 | A | 5/1992 | Brown | |
| 5,226,368 | A | 7/1993 | Brochand et al. | |
| 5,515,789 | A | 5/1996 | Brochand et al. | |
| 5,562,040 | A | 10/1996 | Egli | |
| 5,582,109 | A | 12/1996 | Levi et al. | |
| 5,595,122 | A | 1/1997 | Levi et al. | |
| 6,036,282 | A | 3/2000 | Clarke et al. | |
| 6,345,578 | B1 | 2/2002 | Pabst | |
| 6,543,366 | B2 | 4/2003 | Pabst et al. | |
| 6,585,232 | B2 | 7/2003 | Rechenmacher | |
| 7,410,068 | B1 | 8/2008 | Andreetto | |
| 7,549,377 | B2 | 6/2009 | Pabst | |
| 2002/0026839 | A1 | 3/2002 | Lehtovaara | |
| 2002/0088368 | A1 | 7/2002 | Pabst et al. | |
| 2006/0249718 | A1 | 11/2006 | Levi | |
| 2007/0169660 | A1 | 7/2007 | Pabst | |
| 2008/0115689 | A1 | 5/2008 | Heil et al. | |
| 2009/0165666 | A1 | 7/2009 | Pabst et al. | |
| 2009/0165668 | A1 | 7/2009 | Andreetto | |
| 2012/0090500 | A1 * | 4/2012 | Hinteregger | 105/149.2 |

FOREIGN PATENT DOCUMENTS

| | | |
|---|---|---|
| AT | 373832 | 2/1984 |
| AT | 388146 | 5/1989 |
| AT | 390926 | 7/1990 |
| CH | 259291 | 1/1949 |
| CH | 360704 | 3/1962 |
| CH | 554761 | 10/1974 |
| DE | 423865 | 1/1926 |
| DE | 2020746 | 12/1971 |
| DE | 2101743 | 9/1972 |
| DE | 3109294 | 10/1982 |
| DE | 3834116 | 5/1989 |
| DE | 3927757 | 3/1991 |
| DE | 4127373 | 2/1993 |
| EP | 0055955 | 7/1982 |
| EP | 0135239 | 3/1985 |
| EP | 0218306 | 4/1987 |
| EP | 0218897 | 4/1987 |
| EP | 0281205 | 9/1988 |
| EP | 0491632 | 6/1992 |
| EP | 0517622 | 12/1992 |
| EP | 0613807 | 9/1994 |
| EP | 0640518 | 3/1995 |
| EP | 0678433 | 10/1995 |
| EP | 0687607 | 12/1995 |
| EP | 0692418 | 1/1996 |
| EP | 0745526 | 12/1996 |
| EP | 0970864 | 1/2000 |
| EP | 1077167 | 2/2001 |
| EP | 1088729 | 4/2001 |
| EP | 1174323 | 1/2002 |
| EP | 1 195 305 | 4/2002 |
| EP | 1209055 | 5/2002 |
| EP | 1 331 151 | 7/2003 |
| EP | 1364853 | 11/2003 |
| EP | 1419950 | 5/2004 |
| FR | 891743 | 3/1944 |
| FR | 913146 | 8/1946 |
| FR | 1100001 | 9/1955 |
| FR | 1199721 | 12/1959 |
| FR | 1423648 | 1/1966 |
| FR | 2340895 | 9/1977 |
| FR | 2387830 | 11/1978 |
| FR | 2391450 | 12/1978 |
| FR | 2392858 | 12/1978 |
| FR | 2562857 | 10/1985 |
| FR | 2670452 | 6/1992 |
| FR | 2706404 | 12/1994 |
| FR | 2823482 | 10/2002 |
| FR | 2867142 | 9/2005 |
| GB | 1326264 | 8/1973 |
| GB | 1353030 | 5/1974 |
| GB | 1460106 | 12/1976 |
| GB | 2017024 | 9/1979 |
| JP | 60-85272 | 6/1985 |
| WO | WO2004067347 | 8/2004 |
| WO | WO2004085221 | 10/2004 |
| WO | WO2005032901 | 4/2005 |
| WO | WO 2008/020021 | 2/2008 |
| WO | WO2008129019 | 10/2008 |
| WO | WO2009019259 | 2/2009 |
| WO | WO2009053485 | 4/2009 |

* cited by examiner

CHAIR-LIFT

PRIORITY CLAIM

This application is a national stage application of PCT/EP2008/054771, filed Apr. 18, 2008, which claims the benefit of and priority to Italian Patent Application No. MI2007U 000157, filed on Apr. 20, 2007, the entire contents of which are incorporated herein.

TECHNICAL FIELD

The present disclosure relates to a chair-lift. More specifically, the present disclosure relates to a chair-lift comprising a chair, in turn comprising a seat, a safety bar movable between an open position and a closed position, and at least one footrest bar.

BACKGROUND

In certain known chair-lifts, the footrest bar is supported rigidly by the safety bar, as shown, for example, in Patent Application FR 2,854,853, and therefore cannot be moved with respect to the seat independently of the safety bar. On the other hand, passengers often need to arrange their skis and/or feet positioned underneath the footrest bar. On these known chair-lifts, this can only be done by lifting the safety bar into the open position, thus endangering all the passengers on the chair.

In other types of known chair-lifts, each chair is equipped with a lock device that only allows the safety bar to be raised at the departure and arrival stations, so passengers in this case have no possibility whatsoever of changing position.

SUMMARY

It is an advantage of the present disclosure to provide a chair-lift designed to eliminate the drawbacks of the known art.

According to various embodiments of the present disclosure, there is provided a chair-lift comprising a number of transportation units, each of which comprises a chair, in turn comprising a seat, a safety bar movable about a first axis between an open position and a closed position, and at least one footrest bar supported by the safety bar. The chair-lift being configured such that the footrest bar is mounted to rotate about a second axis to move the footrest bar with respect to the seat.

Additional features and advantages are described in, and will be apparent from, the following Detailed Description and the figures.

BRIEF DESCRIPTION OF THE DRAWINGS

A non-limiting embodiment of the present disclosure will be described by way of example with reference to the accompanying drawings, in which.

DETAILED DESCRIPTION

Figure 1:
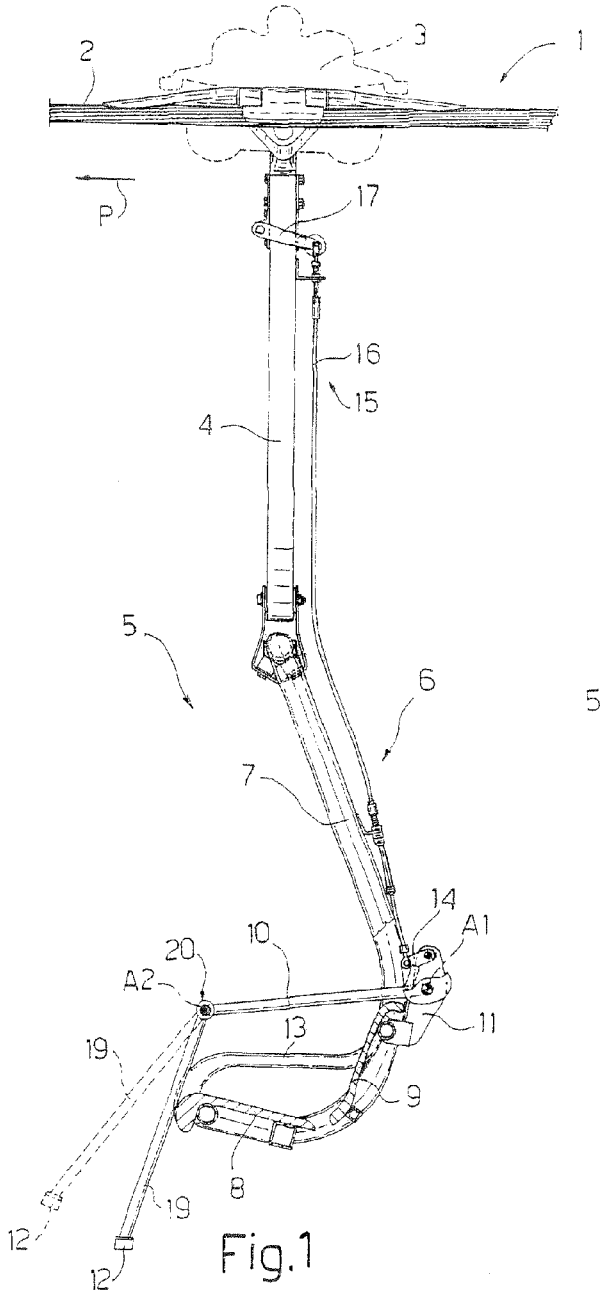
FIG. 1 shows a partly sectioned, partly schematic side view of a chair-lift in accordance with one embodiment of the present disclosure and in a first operating position.
Figure 2:
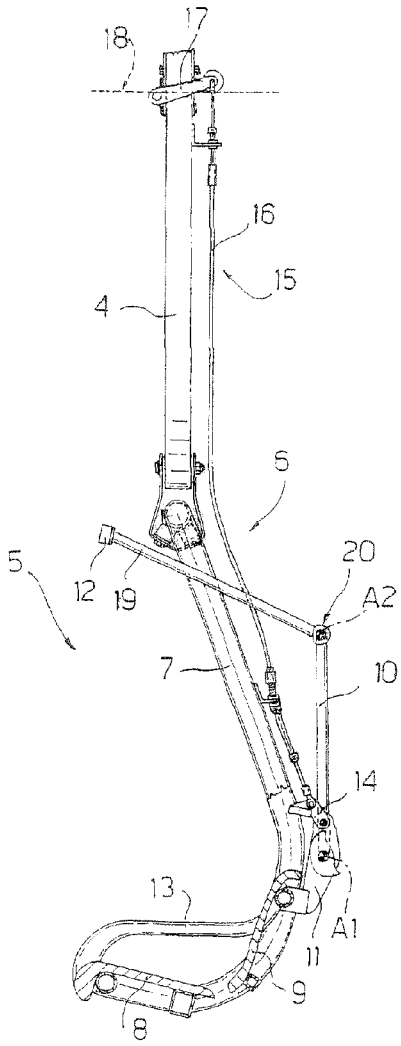
FIG. 2 shows a partly sectioned side view, with parts removed for clarity, of the chair-lift of FIG. 1 in a second operating position.

Referring now to the example embodiment of the present disclosure illustrated in FIGS. 1 to 6, number 1 in FIG. 1 indicates as a whole a chair lift for passenger transport. Chair-lift 1 comprises a cable 2 extending along an endless path P between a departure station (not shown) and an arrival station (not shown); and a number of transportation units equally spaced along cable 2. Only one of the transportation units is shown in FIGS. 1 and 2. The transportation unit comprises a clamping device 3 (shown in phantom in FIG. 1); a supporting bar 4 fixed at the top end to clamping device 3; a chair 5 fixed to supporting bar 4; and a lock device 6 connected to supporting bar 4 and chair 5.

Chair 5 comprises a frame 7; a seat 8; a backrest 9; a safety bar 10; two flanges 11 supporting safety bar 10; a footrest bar 12; and two armrests 13, only one of which is shown in FIG. 1.

Safety bar 10 is mounted to rotate, about a substantially horizontal axis A1 and with respect to flanges 11, between a closed position (FIG. 1) and an open position (FIG. 2).

Lock device 6 serves to only enable opening of safety bar 10 at the departure and arrival stations of chair-lift 1, and comprises a cam 14 movable between a lock position (FIG. 1) and a release position (FIG. 2); and a control member 15 for moving cam 14 from the lock position to the release position. Cam 14 is fitted to one of flanges 11, cooperates with a portion of safety bar 10, and is maintained in the lock position by a spring (not shown). Control member 15 comprises a Bowden cable 16; and a lever 17 activated by a rail at the departure and arrival stations, and of which the dash line in FIG. 2 shows the contact surface 18 contacting lever 17.

Footrest bar 12 is connected to safety bar 10 by an arm 19 and a hub 20, and is hinged to safety bar 10, about an axis A2 substantially parallel to axis A1, to rotate between the position shown by the continuous line in FIG. 1, in which arm 19 substantially rests against seat 8, and the position shown in phantom.

Figure 5:
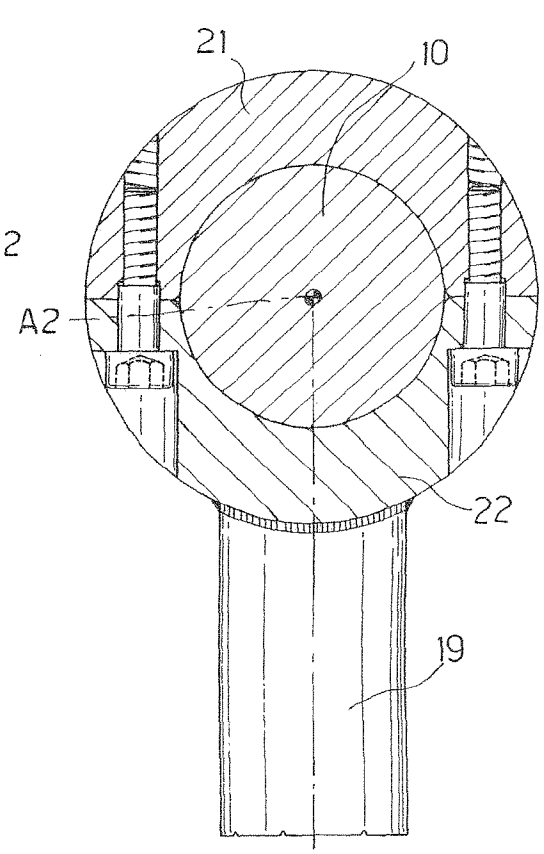
FIG. 5 shows a larger-scale section, with parts removed for clarity, of a detail of the chair-lift of FIG. 1.
Figure 4:
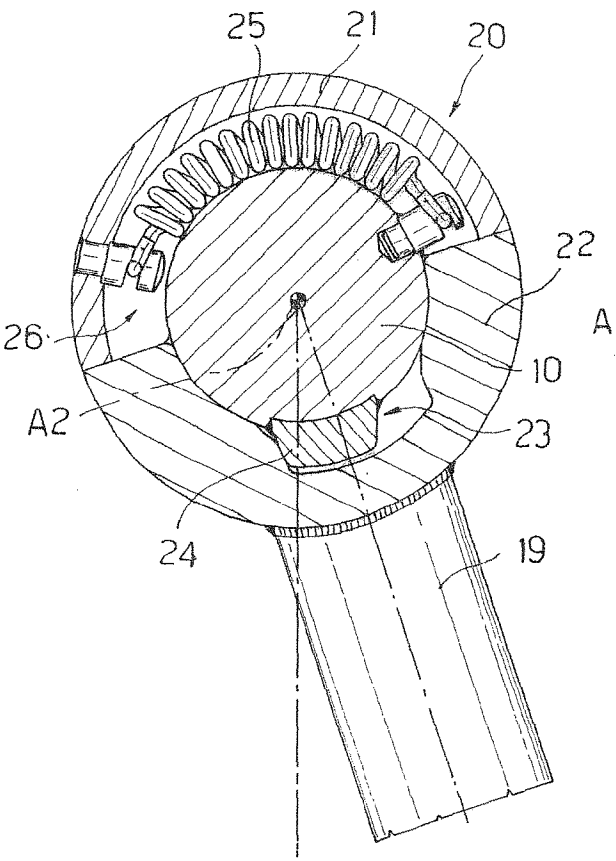
FIG. 4 shows a larger-scale section, with parts removed for clarity, of a detail of the chair-lift of FIG. 1.
Figure 3:
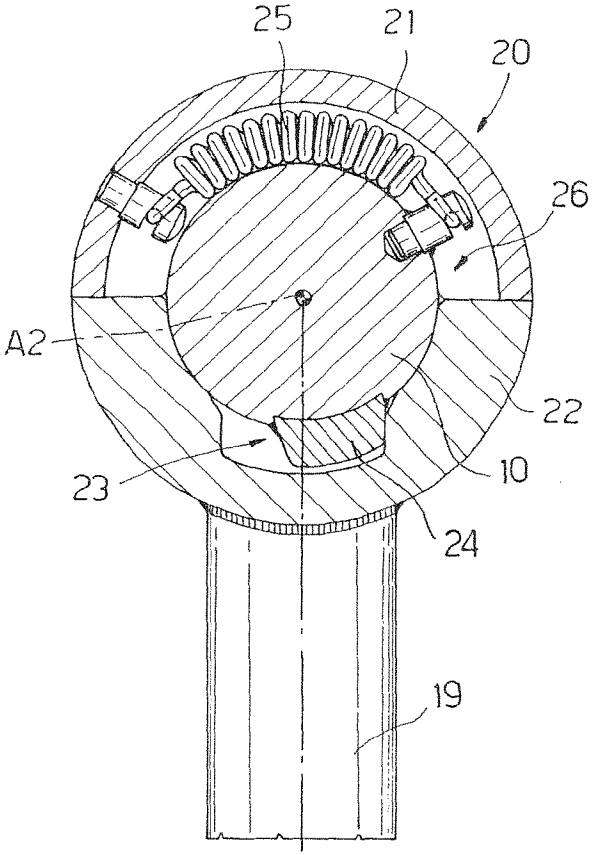
FIG. 3 shows a larger-scale section, with parts removed for clarity, of a detail of the chair-lift of FIG. 1.

With reference to FIGS. 3, 4 and 5, hub 20 comprises two half-shells 21 and 22 fitted to each other and surrounding a portion of safety bar 10, which acts as a pin.

Safety bar 10 and hub 20 are connected to prevent arm 19 sliding along second axis A2. More specifically, hub 20 has an annular seat 23, and safety bar 10 has a projection 24 engaging annular seat 23.

Safety bar 10 and hub 20 are also connected to limit rotation of hub 20 about safety bar 10, by projection 24 engaging annular seat 23, which extends a given angle of less than one-hundred-eighty degrees) (180°).

Chair 5 includes a spring 25 located between footrest bar 12 and safety bar 10 to keep arm 19 resting against seat 8. More specifically, spring 25 is housed inside hub 20, and has one end connected to hub 20, and one end connected to safety bar 10. Hub 20 has a seat 26 for housing spring 25.

In use, when safety bar 10 is in the closed position, footrest bar 12 can be moved in opposition to spring 25 to enable passengers to rearrange their skis with respect to footrest bar 12. When footrest bar 12 or arm 19 is released by the passenger, spring 25 restores arm 19 into position resting against seat 8.

Figure 6:
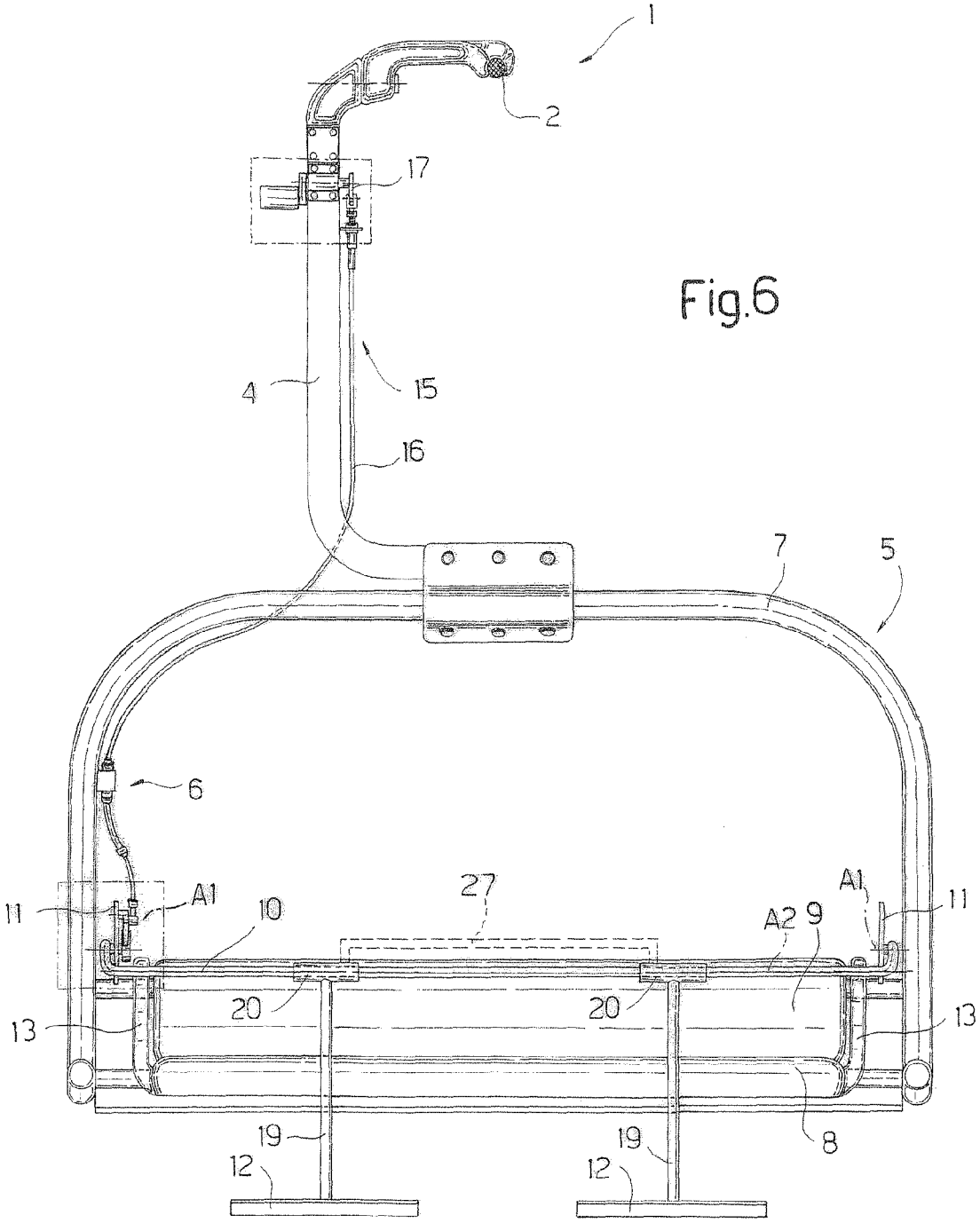
FIG. 6 shows a partly sectioned front view, with parts removed for clarity, of the chair-lift of FIG. 1.

With reference to FIG. 6, chair 5 is equipped with two footrest bars 12, each as described with reference to FIGS. 1 to 5, and each rotatable about axis A2 independently of the other footrest bar 12.

In a variation, footrest bars 12 are connected to each other by a control bar 27 shown in phantom in FIG. 6 and connecting hubs 20 of footrest bars 12.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. A chair-lift comprising:

a quantity of transportation units, each transportation unit including:

a chair having a seat and an elastic member;

a safety bar configured to move about a first axis between an open position and a closed position; and at least one footrest bar supported by the safety bar and mounted to rotate about a second, different axis to move the footrest bar with respect to the seat, said footrest bar being connected by an arm to the safety bar, the arm being configured to rotate about the safety bar, the elastic member of the chair being located between the at least one footrest bar and the safety bar and being configured to keep the arm resting against the seat.

2. The chair-lift of claim 1, wherein for each transportation unit, the arm is connected to the safety bar by a hub hinged to the safety bar about the second axis.

3. The chair-lift of claim 2, wherein for each transportation unit, the safety bar and the hub are connected to prevent the arm from sliding along the second axis.

4. The chair-lift of claim 3, wherein for each transportation unit, the hub has an annular seat, and the safety bar has a projection configured to engage the annular seat.

5. The chair-lift of claim 4, wherein for each transportation unit, the safety bar and the hub are connected to limit rotation of the hub about the safety bar.

6. The chair-lift of claim 5, wherein for each transportation unit, the annular seat extends a designated angle of less than 180°.

7. The chair-lift of claim 1, wherein for each transportation unit, the second axis is parallel to the first axis.

8. The chair-lift of claim 1, wherein each transportation unit includes an automatic lock device configured to lock the safety bar in the closed position.

9. The chair-lift of claim 1, wherein each transportation unit includes at least two footrest bars, each configured to rotate about the second axis.

10. The chair-lift of claim 9, wherein for each transportation unit, each footrest bar is configured to rotate about the second axis independently of the other footrest bar.

11. The chair-lift of claim 9, wherein for each transportation unit, the footrest bars are connected to each other by a control bar, and are configured to rotate jointly about the second axis.

12. A chair-lift transportation unit comprising:

a chair having a seat;

a safety bar configured to move about a first axis between an open position and a closed position; and at least two footrest bars supported by the safety bar and mounted to rotate about a second, different axis to move the footrest bars with respect to the seat, wherein each footrest bar is configured to rotate about the second axis independently of the other footrest bar.

13. A chair-lift transportation unit comprising:

a chair having a seat;

a safety bar configured to move about a first axis between an open position and a closed position, said safety bar having a projection;

at least one footrest bar supported by the safety bar and mounted to rotate about a second, different axis to move the footrest bar with respect to the seat, said second axis being parallel to the first axis, the footrest bar connected by an arm to the safety bar, the arm configured to rotate about the safety bar and connected to the safety bar by a hub hinged to the safety bar about the second axis, the safety bar and said hub connected to prevent the arm from sliding along the second axis, the hub having an annular seat that extends a designated angle of less than 180°, the annular seat configured to be engaged by the projection of the safety bar, and the safety bar and the hub are connected to limit rotation of the hub about the safety bar, and an automatic lock device configured to lock the safety bar in the closed position.

14. The chair-lift transportation unit of claim 13, wherein the chair includes an elastic member located between the footrest bar and the safety bar and configured to keep the arm resting against the seat.

15. The chair-lift transportation unit of claim 13, which includes at least two footrest bars, each configured to rotate about the second axis, each footrest bar is configured to rotate about the second axis independently of the other footrest bar.

16. The chair-lift transportation unit of claim 15, wherein the footrest bars are connected to each other by a control bar, and are configured to rotate jointly about the second axis.

17. A chair-lift comprising:

a quantity of transportation units, each transportation unit including:

a chair having a seat;

a safety bar configured to move about a first axis between an open position and a closed position;

an automatic lock device configured to lock the safety bar in the closed position; and at least two footrest bars supported by the safety bar and mounted to rotate about a second, different axis to move the footrest bar with respect to the seat, wherein each footrest bar is configured to rotate about the second axis independently of the other footrest bar.

18. The chair-lift of claim 17, wherein for each transportation unit, the second axis is parallel to the first axis.

19. A chair-lift comprising:

a quantity of transportation units, each transportation unit including:

a chair having a seat;

a safety bar configured to move about a first axis between an open position and a closed position; and at least two footrest bars supported by the safety bar and mounted to rotate about a second, different axis to move the footrest bars with respect to the seat, wherein each footrest bar is configured to rotate about the second axis independently of the other footrest bar.

20. The chair-lift of claim 19, wherein for each transportation unit, the second axis is parallel to the first axis.

21. A chair-lift comprising:

a quantity of transportation units, each transportation unit including:

a chair having a seat;

a safety bar configured to move about a first axis between an open position and a closed position; and at least two footrest bars supported by the safety bar and mounted to rotate about a second, different axis to move the footrest bars with respect to the seat, wherein the footrest bars are connected to each other by a control bar, and are configured to rotate jointly about the second axis.

22. The chair-lift of claim 21, wherein for each transportation unit, the second axis is parallel to the first axis.

23. A chair-lift comprising:

a quantity of transportation units, each transportation unit including:

a chair having a seat;

a safety bar configured to move about a first axis between an open position and a closed position;

an automatic lock device configured to lock the safety bar in the closed position; and at least two footrest bars supported by the safety bar and mounted to rotate about a second, different axis to move the footrest bars with respect to the seat, wherein the footrest bars are connected to each other by a control bar, and are configured to rotate jointly about the second axis.

24. The chair-lift of claim 23, wherein for each transportation unit, the second axis is parallel to the first axis.

* * * * *